US005617700A

United States Patent [19]

Wright et al.

[11] Patent Number: 5,617,700

[45] Date of Patent: Apr. 8, 1997

[54] PREFABRICATED BUILDING PANEL

[76] Inventors: Jerauld G. Wright, Suite 100, 56 Sparks Street, Ottawa, Ontario, Canada, K1P 5A9; Sidney K. Tissington, Box 2332, Chilliwack, British Columbia, Canada, V2R 1A6

[21] Appl. No.: 503,389

[22] Filed: Jul. 17, 1995

[51] Int. Cl.[6] ..... E04C 2/32

[52] U.S. Cl. ..... 52/793.1; 52/794.1; 52/698

[58] Field of Search ..... 52/784.14, 784.15, 52/793.11, 793.1, 794.1, 656.8, 668

[56] References Cited

U.S. PATENT DOCUMENTS

| | | | |
|---|---|---|---|
| 2,511,620 | 6/1950 | Clements | 52/784.14 X |
| 3,462,897 | 8/1969 | Weinrott . | |
| 4,130,605 | 10/1978 | Barkhuff, Jr. | 260/876 |
| 4,163,349 | 8/1979 | Smith . | |
| 4,409,770 | 10/1983 | Kawaguchi et al. | 52/793.11 X |
| 4,489,530 | 12/1984 | Chang . | |
| 4,671,032 | 6/1987 | Reynolds | 52/793.11 X |
| 4,765,105 | 8/1988 | Tissington et al. . | |
| 4,894,974 | 1/1990 | Mayhew et al. | 52/668 X |
| 5,157,892 | 10/1992 | Ryther | 52/668 X |

FOREIGN PATENT DOCUMENTS 2163190 2/1986 United Kingdom .

*Primary Examiner*—Carl D. Friedman
*Assistant Examiner*—Timothy B. Kang
*Attorney, Agent, or Firm*—Woodard, Emhardt, Naughton Moriarty & McNett

[57] ABSTRACT

A prefabricated building panel comprises a wooden grid of crossing longitudinal and transverse studs which are notched to interengage at the crossing points, one array of studs having surfaces coinciding with one major surface of the panel and having opposed surfaces recessed from the opposite major surface of the panel and vice-versa. The studs which are made of standard dimension lumber provide adequate nailing surfaces on each of the major surfaces of the panel for attachment of finish sheeting such as drywall thereto after installation. The panel may include molded in situ insulation and provides on the inner side of the panel large longitudinally recessed channels through which electric wiring, plumbing and the like can be ducted.

24 Claims, 3 Drawing Sheets

PREFABRICATED BUILDING PANEL

BACKGROUND OF THE INVENTION

A) Field of the Invention

This invention relates to a new or improved prefabricated building panel designed for use in building structures of many different types including both residential and commercial.

B) Description of the Prior Art

The construction of buildings and in particular of residential buildings is labour intensive and involves numerous problems, among which may be mentioned quality control, high labour costs, lack of uniformity in design, as well as difficulties in erection. Transportation and materials handling costs can be high, and the construction is often hampered by adverse weather conditions.

The foregoing problems have been well recognized over the years and attempts have been made to overcome them in various ways. For example, the use of "factory built" housing involving the fabrication of modules or even complete structures in factory conditions for transportation and erection on site offers many advantages in terms of quality control, weather protection and the like, but lacks flexibility.

Other attempts at improving building practices have involved the provision of prefabricated insulated building panels of standard dimensions since it has been realized that by their use there is a potential to achieve great savings in labour and construction costs in the fabrication of various types of buildings. Examples of such building panels and prefabricated construction methods can be seen, for example, in the following U.S. patents:

U.S. Pat. No. 3,642,897—Weinrott

U.S. Pat. No. 3,949,529—Porter

U.S. Pat. No. 4,163,349—Smith

U.S. Pat. No. 4,269,006—Larrow

The foregoing represent but a small selection of prior proposals, but none of them achieves all of the features that are considered to be most desirable in building panels of this type, so that despite very many years of development, there are few such prefabricated insulated building panels being successfully employed commercially.

From a review of the requirements of the construction industry in manufacture and erection, the inventors have concluded that, to be successful, a prefabricated insulated building panel must provide most if not all of the following benefits:

1. low purchase cost and finish cost
2. rapid on-site erection
3. capability of use by low-skilled labour
4. good protection from the elements, and resistance to degradation by moisture, insects, etc.
5. robustness so as to have good built-in resistance to rough handling
6. the ability to accept virtually any type of exterior or interior finish
7. lifetime durability with minimum maintenance
8. easy adaptation to a wide variety of uses from one or not more than a small number of standard factory manufactured panel sizes
9. a high degree of salvageability for reuse in the event of minor damage or improper cutting 10. the ability for easy and quick replacement of damaged panels
11. an absence of nails, staples or other such fasteners within the panel structure so that the panel can be readily cut to size without the use of specialized saws.

Of all prior art panel structures, the one that comes closest to providing the above characteristics is that disclosed in U.S. Pat. No. 4,765,105 Tissington et al. The Tissington et al. panel has enjoyed a good measure of commercial success, having been employed in numerous residential, commercial and industrial applications and has been demonstrated to give superior insulating properties and significant cost savings as compared to more conventional building systems. The Tissington et al. structure comprises a stressed skin panel provided in standard sizes, typically 8 feet by 24 feet, having outer sheets of oriented strand board and an internal structure comprising a web of interlocking vertical and horizontal stud members cut from sheets of oriented strand board and creating cells that are filled with a polyurethane insulation that binds the structure and when hardened provides structural integrity and great stiffness. These panels have been shown to provide great strength and dimensional stability and are excellent for use in walls, floors and roofs in residential, industrial, commercial, institutional and agricultural buildings.

The Tissington et al. panels when integrated into buildings are easily finished by conventional methods. Drywall can readily be applied to interior walls or ceilings without the need for a vapour barrier (since the panel itself is impervious to water vapour) and exterior surfaces can easily be finished by applying thereto conventional siding or stucco. The panels have a continuous built-in header so that window and door openings can readily be cut out after manufacture, e.g. at the time of erection.

Because of the above discussed and other features, the Tissington et al. building panel achieves almost all of the above enumerated desirata. However applicants have now devised a prefabricated building panel which is even better adapted to fit a wide range of applications than the Tissington et al. panel and at the same time offers improvements in terms of weight, cost, and adaptability.

SUMMARY OF THE INVENTION

The invention provides a prefabricated building panel of predetermined length, width, and thickness, comprising a grid formed by a first planar array of spaced parallel longitudinal members and a second planar array of spaced parallel transverse members, said arrays being parallel to each other and intersecting within the area of the panel at a series of regularly spaced crossing points, at each crossing point at least one of said members being notched in the thickness direction of the panel to interengage with the respective member of the other arrays such that said arrays overlap in said thickness direction; all of said members being of wood and said longitudinal members presenting nailing surfaces at one major surface of the panel and said transverse members presenting nailing surfaces at an opposite major surface of the panel, said transverse members being recessed with respect to said one major surface.

The panel is preferably fabricated from standard dimension lumber, for example the first and second planar arrays comprising nominal two inch by four inch cross-section pieces that are notched at the crossing points to overlap in the thickness direction of the panel by about one and a half inches so that the thickness of the panel overall is about five and a half inches. With this arrangement there are longitudinally extending recesses of approximately two inches in depth on what is intended to be the interior face of the building panel, these recesses providing spaces to apply header boards or footer boards and also to accommodate electrical and other wiring, plumbing, etc.

As manufactured, the panel is of the "skinless" type in that unlike the above described Tissington et al. panel it does not include oriented strand board sheets on its opposite sides and is accordingly considerably lighter and cheaper. Such sheets could of course be included in the panel according to the invention if desired, but in skinless form the panel provides greater flexibility as to the particular finishing that is applied, and also of course maintains access to the inner side recesses of the panel until wiring and like services have been installed, whereafter that side of the panel can be finished e.g. by the application of drywall.

The novel panel preferably includes foamed polymeric insulation material, such as polyurethane, filling the grid areas thereof, this foam insulation being applied during manufacture in a press so that it is intimately bonded to the members of the grid extending from one major surface of the panel to a thickness corresponding to that of the members which extend from that face, to leave unimpeded recesses between the members which extend to the opposite major face. Indeed the foam insulation may have a thickness that is slightly greater than the corresponding dimension of the frame members so as to completely cover the one set of frame members at least at the first major surface of the panel.

Alternatively if preferred the panel may be provided without insulation, to be insulated later after erection using locally available insulation materials.

BRIEF DESCRIPTION OF THE DRAWINGS

The invention will further be described, by way of example only, with reference to the accompanying drawings wherein.

DESCRIPTION OF THE PREFERRED EMBODIMENTS

Figure 1:
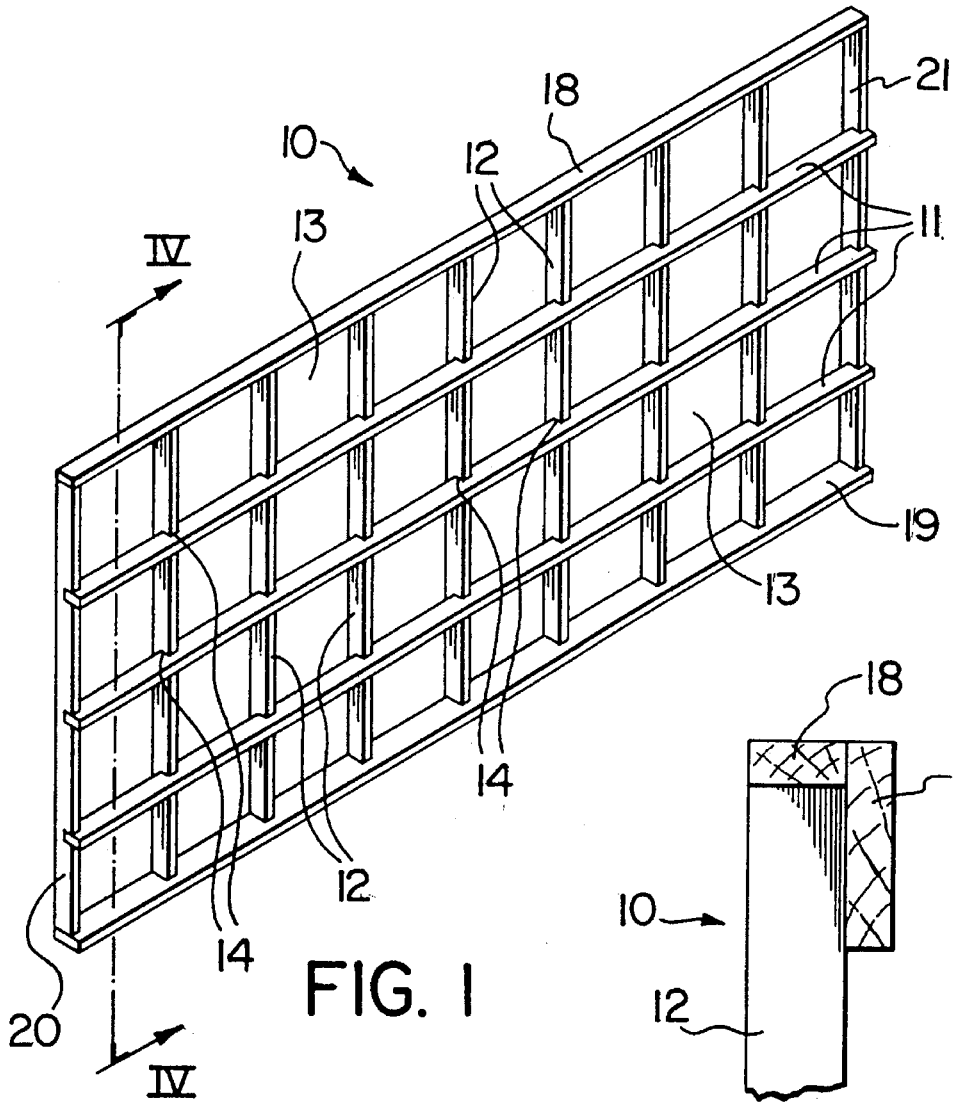
FIG. 1 is a perspective view of a building panel in accordance with the invention.

As shown in FIG. 1 a prefabricated building panel 10 comprises an open grid framework formed by two arrays of parallel members 11 and 12, the members 11 of one array being at right angles to the members 12 of the other array. As seen in FIG. 1 the panel 10 is shown in a generally vertical orientation and has a length that is greater than its height, so that for convenience of reference the grid members 11 are referred to herein as horizontal members, and the grid members 12 as vertical members. It will however be appreciated that the panel 10 can be oriented in any desired way, and when used as flooring will be oriented horizontally and when used as a roofing panel may be oriented at an inclination. The panel may be fabricated in any suitable dimensions and conveniently has a height of approximately 8 feet and a length of 24 feet, such height corresponding to the usual wall height in residential buildings.

Figure 4:
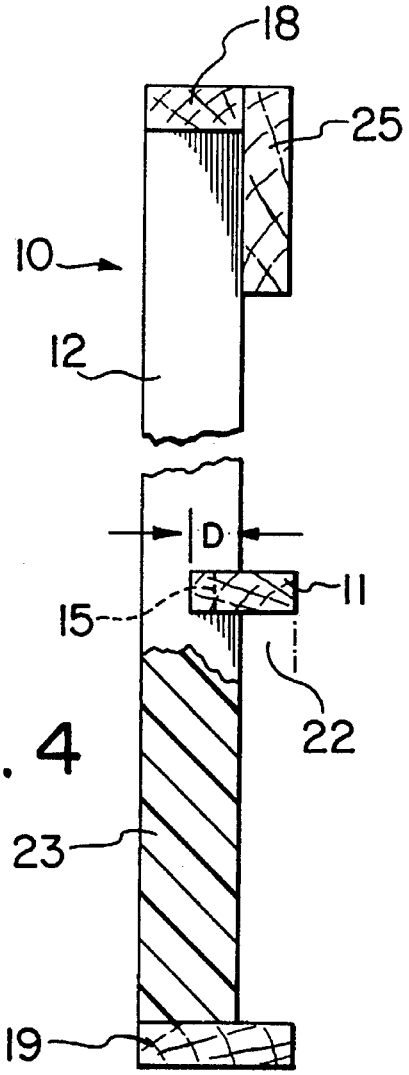
FIG. 4 is a sectional view taken on the line IV—IV in FIG. 2.

The members 11 and 12 are provided as studs of standard dimension lumber (SDL) arranged at regular spacing both horizontally and vertically. As shown the studs 11 and 12 are on nominal 2×4 inch section lumber at 24 inch centers providing a grid having uniform square holes. The studs 11 and 12 are notched to interengage at the various crossing points 14 so as to form a stiff and dimensionally stable framework. The nature of the notching is explained more fully in relation to FIG. 4 which shows the interengagement of a single horizontal grid member 11 with one of the vertical grid members 12. The arrays of grid members 11 and 12 overlap in the thickness dimension of the panel by the amount D. To achieve this degree of overlap it would be possible to notch only one of the members 11 and 12 to the depth D while leaving the other member unnotched. However such an arrangement would not restrain the notched member from rotating about its longitudinal axis relative to the unnotched member. While in a grid pattern this difficulty could be overcome by notching different grid members at alternate crossing points, it is preferred as shown in FIG. 4 to provide at each crossing point notches in each of the grid members as represented by the broken line 15 to a depth of half D since this simplifies the manufacturing procedure and ensures a grid in which the crossing grid members are firmly secured and rigidly interconnected (in all directions except the thickness direction of the panel) merely by the notched interconnection. This enables the wall panel to be fabricated without the inclusion of any metal fasteners such as nails or staples in the internal areas thereof.

Upper and lower perimeter frame members 18 and 19 extend horizontally at the upper and lower edges of the panel as shown and are nailed to the ends of the vertical grid members 12 thus securing these in place. End frame members 20 and 21 may be provided in similar manner to the upper and lower frame members, or may simply constitute notched vertical grid members to which the ends of the horizontal grid members 11 are fastened by nails or other suitable fasteners. In any event with the ends of the vertical and horizontal grid members suitably secured to the perimeter framing 18, 19, 20, 21, a rigid panel structure is achieved in which the crossing grid members 11 and 12 are secured in permanent engagement, without the use of any metal fasteners except in the perimeter framing.

As will be evident from the foregoing and from the drawings and in particular FIGS. 1 and 4, since both the horizontal grid members and the vertical grid members extend in the thickness direction of the panel from a respective major face thereof but are spaced from the opposed major face thereof, there are provided on one side of the panel large recesses such as indicated at 22 in FIG. 4 these recesses extending parallel to the horizontal grid members 11 from one end to the other end of the panel 10 without interruption.

From FIG. 4 it will be seen that the dimension of the upper frame member 18 in the thickness direction of the panel corresponds to that of the vertical studs 12 whereas the lower frame member 19 is wider in this direction and projects beyond the studs 12 to an extent that corresponds with the projection of the horizontal grid member 11 and thus defines the lower end of one of the horizontally extending recesses 22.

Figure 2:
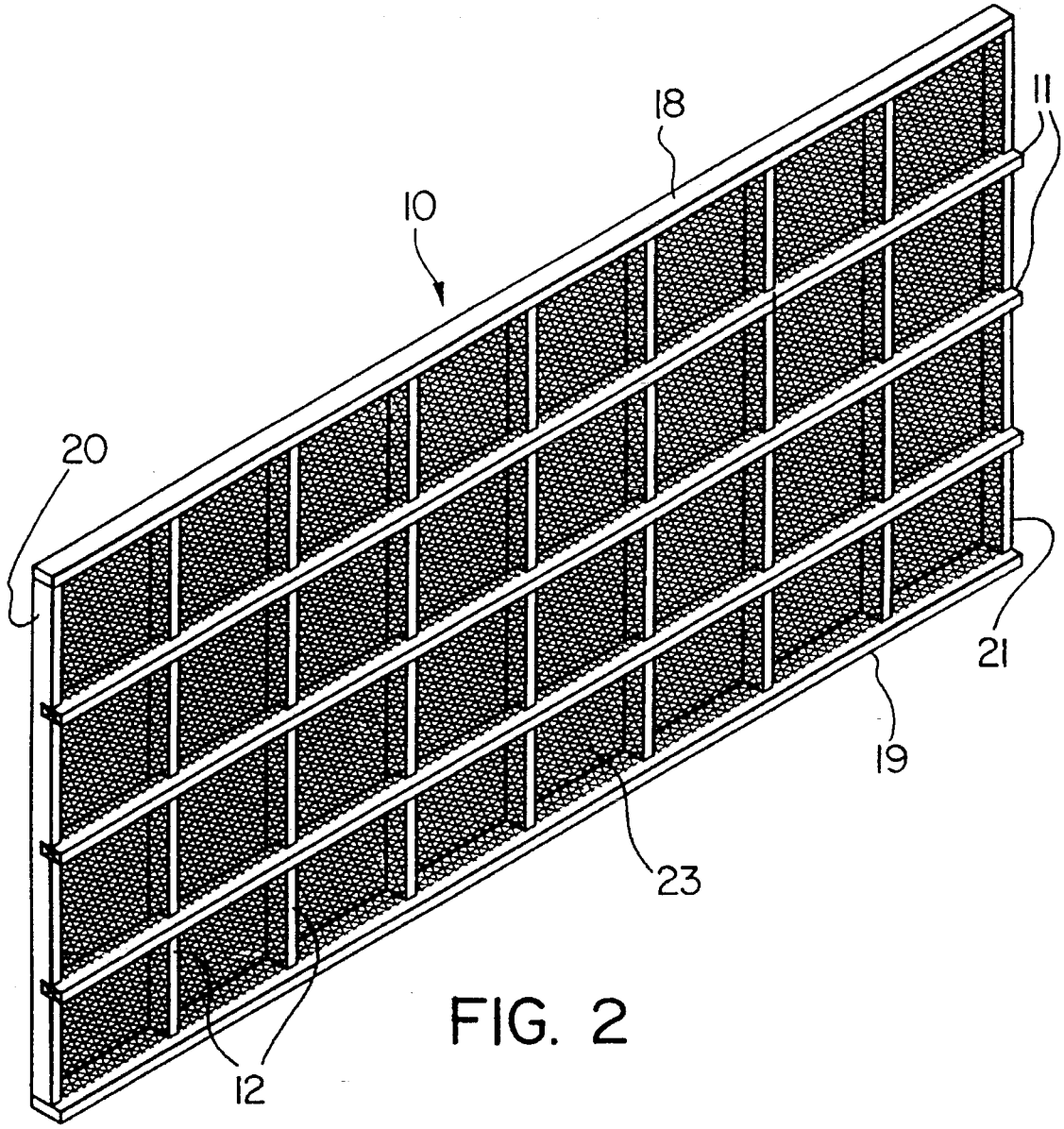
FIG. 2 is a view similar to FIG. 1 showing the building panel including insulation.

The modular building panel can be provided in the form as shown in FIG. 1 for use in a building construction, insulation of the panel being installed after erection by any suitable means. However it is preferred to provide the building panel as shown in FIG. 2 with molded in situ insulation 23 filling the holes 13 throughout the grid. The insulation 23 may be molded in situ at the time of fabrication in a suitable press so that it completely fills the holes 23 to a depth as shown in FIG. 4 corresponds to the dimension of the vertical grid members 12 in the thickness direction of the panel. A suitable insulation material would be polyurethane foam which can be formulated to completely fill the desired space and bond to the surfaces of the members 11 and 12 to provide excellent thermal insulation in the panel. If desired the insulation could be made slightly thicker than the vertical members 12 so as to completely enclose these on all sides. However it is preferred to ensure that the foam material does not encroach unduly on the recesses 22 on the inner surface of the panel.

As mentioned, the horizontal and vertical grid members are suitably of nominal 2 inch by 4 inch section studs having actual cross-section of approximately 1.5×3.5 inches. If the overlap D in the grid is 1.5 inches, then the panel will have an overall thickness of approximately 5½ inches and the recess 22 will have a depth of approximately 2 inches.

Panels fabricated as described above can be readily utilized in a building situation since they can easily be cut to length on site without the requirement for highly skilled labour or special cutting equipment. As mentioned, there are no metal fasteners within the area of the panel, so that it can be cut virtually along any line, either vertical, horizontal or diagonal, by a normal wood working saw. Furthermore, the panel 10 is readily adaptable to accomodate a longitudinally extending header 25 (see FIG. 4) which can be nailed to the upper frame member 18 and to the upper ends of the vertical grid members 12 should the upper edge of the panel require reinforcing, e.g. at the location of window or door openings, or to support heavy roof loads.

Figure 3:
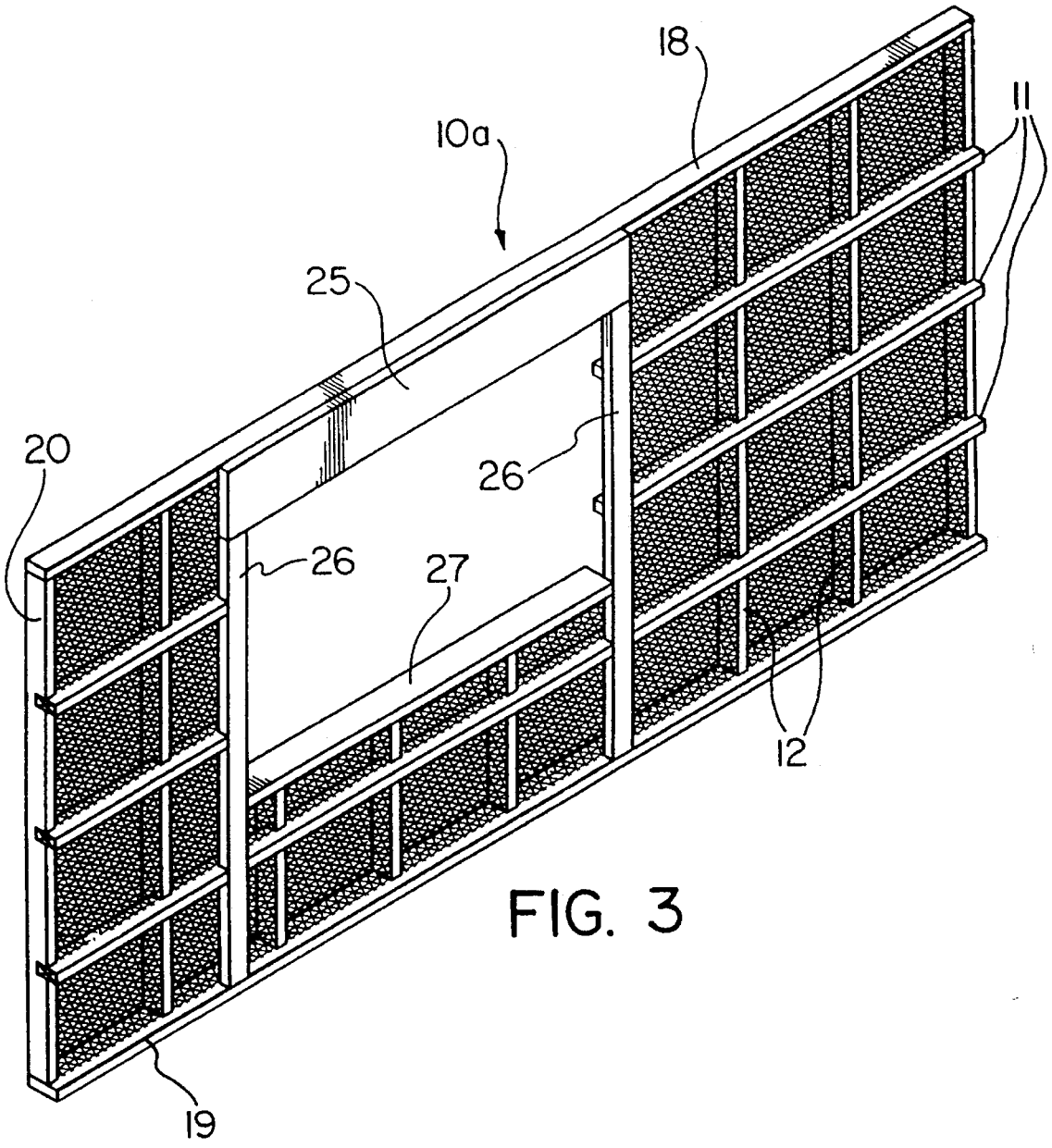
FIG. 3 is a view similar to FIG. 1 showing the building panel including a window frame.

Additionally, the panel can readily be modified to accomodate framing for windows, doors and other openings as is illustrated in FIG. 3. All that is required is to cut from the panel an opening of suitable dimensions and then insert suitable framing lumber which can be nailed to the members of the panel to provide strengthening members and means to which the window frame (not shown) can be attached. Thus as seen in FIG. 3, the upper edge of the panel is reinforced by the provision of a horizontal header 25 (suitably SDL lumber of nominal 2 by 8 inch size) nailed to the upper frame member 18. The ends of the header 25 are supported on vertical posts 26 which likewise can be built up of standard dimension lumber to whatever size is required and which are fastened to the cut ends of the horizontal grid members 11. It will be seen that to accomodate the lower parts of the vertical posts 26 it is not necessary to cut away areas of the insulation. The lowermost horizontal grid member 12 has to be notched, but this can be effected without difficulty and without in any way jeopardizing the structural integrity of the panel.

Finally the lower side of the opening is reinforced by a horizontal sill 27 fastened to the cut ends of the vertical grid members 12. Accordingly, a window opening can be fabricated in the panel in virtually any position and utilizing standard carpentry techniques.

A doorway (not shown) can be fabricated in the building panel in a manner quite similar to that described above in relation to the window opening.

Cut panels can be secured end-to-end by providing an additional unnotched vertical frame member (not shown) nailed to the cut ends of the horizontal grid members 11 and in alignment with the other vertical grid members 12, this additional vertical member providing a means for fastening the panel to a like panel.

It will be understood that after installation, the panel can be finished on its interior and exterior surfaces in any suitable manner. For example various forms of siding, shingles, brick, or the like can be provided on the outer side whereas the inner side (after installation of various services in the recesses 22) will normally be finished by applying a layer of drywall sheeting or other paneling.

The notched interengagement of the longitudinal and transverse grid members at the crossing points provides a firm interengagement at these locations, particularly in view of the fact that the notches can be machined very accurately to provide a close fit. In the finished panel which includes foamed in situ insulation, the insulation bonds to the cross grid members and prevents any tendency for them to separate in the thickness direction of the panel at the crossing points. However where the panel is fabricated as a bare grid without the inclusion of insulation, some additional means to prevent separation at the crossing points may be desirable. For the reasons explained it is however disadvantageous to secure these connections by metal fasteners, and accordingly in these circumstances suitable glues or adhesives are employed within the interengaging notches to bond the crossing members securely together. This bonding step can readily be performed at the time of manufacture.

While the wooden framework per se as described and illustrated is of appreciable strength and rigidity, these properties are greatly enhanced by the addition of the foamed in situ insulation, and are further improved by the application of covering sheets such as strand board to one or both of the major surfaces of the panel. However the panel with foamed insulation bonded thereto is of adequate strength and robustness to withstand normal handling and is of course lighter and cheaper to fabricate than a panel having outer sheeting. The polyurethane foam can be formulated to have a relatively tough outer skin which will further enhance the resistance of the panel to damage.

Additionally it becomes economical to provide a wider range of finish coverings to the panel. It is expensive and unnecessary to provide a prefabricated building panel with outer sheeting e.g. of strand board which is ultimately going to be covered over by another finishing material, e.g. siding or drywall.

The horizontal and vertical grid members 11 and 12 of the panel are preferably fabricated from kiln dried lumber. The panel is suitable for use in basement walls also, and in this application is preferably fabricated from pressure treated lumber which has been impregnated with substances which provide a high degree of rot-resistance and which are also insect repelling.

Different finishing treatments will be applied where the building panel is to be utilized as a roofing panel or as a flooring panel. In the latter instance the panel will of course be oriented in an approximately horizontal plane so that the longitudinal members 11 and the transverse members 12 all extend generally horizontally. In this situation, to improve the load bearing capacity of the panel the longitudinal grid members 11 will be made of increased section, typically SDL of 2 inches by 8 inches or 2 inches by 10 inches section. Furthermore, the notching of the members preferably will be such that the transverse members also have surfaces that lie in the horizontal upper surface of the panel. Before or after installation of the flooring panel the upper surface can be finished with any conventional sheeting such as plywood, strand board or the like and foamed or other insulation added.

What we claim as our invention is:

1. A prefabricated building panel of predetermined length, width, and thickness which extend in mutually perpendicular directions, the panel having opposed major surfaces spaced in the thickness direction, comprising a grid formed by a first planar array of spaced parallel longitudinal members and a second planar array of spaced parallel transverse members, said longitudinal members and transverse members intersecting within the panel at a series of regularly spaced crossing points, at each crossing point at least one of said members being notched in the thickness direction of the panel to interengage with the respective member of the other array such that said arrays partially overlap in said thickness direction;

all of said members being of wood and said longitudinal members presenting nailing surfaces at one said major surface of the panel and said transverse members presenting nailing surfaces at the opposite said major surface of the panel, said transverse members being recessed with respect to said one major surface.

2. A prefabricated building panel as claimed in claim 1 wherein said longitudinal members are longer than said transverse members.

3. A prefabricated building panel as claimed in claim 1 wherein at each crossing point both of the respective members are notched, the interengaging notching maintaining the arrays in spaced parallel configuration without the use of additional fastening means in the vicinity of the crossing points.

4. A prefabricated building panel as claimed in claim 1 wherein said grid includes a foamed polymeric insulating material filling substantially all of the areas between said members from one major surface of the panel to a thickness that is less than said panel thickness.

5. A prefabricated building panel as claimed in claim 4 wherein said foamed material is molded in situ and is in intimate contact with said members.

6. A prefabricated building panel as claimed in claim 4 wherein said foamed material has a thickness that substantially corresponds to the thickness of the transverse members in the thickness direction of the panel.

7. A prefabricated building panel as claimed in claim 1 having a peripheral rectangular frame comprising pairs of opposed parallel longitudinal and transverse sides.

8. A prefabricated building panel as claimed in claim 7 wherein at least one pair of said sides comprises members of one of said arrays.

9. A prefabricated building panel as claimed in claim 7 wherein one pair of said sides comprises wooden frame elements that are secured along the respective ends of the members of one of said planar arrays.

10. A prefabricated building panel as claimed in claim 9 wherein one of said frame elements has a dimension in the thickness direction of the panel that corresponds to and is aligned with the dimension of one said array of elements so that on one side said frame element adjoins the first major surface of the panel whereas on its opposite side said frame element is recessed with respect to said opposite major surface of the panel.

11. A prefabricated building panel as claimed in claim 10 wherein said members and said frame elements are of standard dimension lumber.

12. A prefabricated building panel as claimed in claim 1 wherein said members are of standard dimension lumber.

13. A prefabricated building panel as claimed in claim 12 wherein said nailing surfaces have a width in the plane of the respective major surface of at least about one inch.

14. A prefabricated building panel as claimed in claim 13 wherein said members of both arrays are of nominal two by four inch section standard dimension lumber, said nailing surfaces having a width of approximately one and a half inches.

15. A prefabricated building panel as claimed in claim 14 wherein said arrays overlap in said thickness direction by about one and a half inches.

16. A prefabricated building panel as claimed in claim 15 wherein the grid areas between said members are filled with a foam material that extends from one major face of the panel to a thickness that is less than the thickness of the panel so that said foam material is recessed with respect to the second major surface of the panel.

17. A prefabricated building panel as claimed in claim 16 wherein said foam has a thickness that corresponds to the dimension of said transverse members in the thickness direction of the panel and is recessed from said second major surface by at least about one and a half inches.

18. A prefabricated building panel as claimed in claim 17 including a longitudinally extending header having a thickness of approximately one and a half inches, said header extending along one longitudinal edge of the panel within the thickness dimension of the panel and being secured to said transverse members by suitable fastening means.

19. A prefabricated building panel as claimed in claim 18 wherein said grid is interrupted by a window frame that is secured to said longitudinal and transverse members.

20. A prefabricated building panel as claimed in claim 1 wherein at each crossing point the respective grid members are secured together without the use of metal fasteners.

21. A prefabricated building panel of predetermined length, width, and thickness which extend in mutually perpendicular directions, the panel having opposed major surfaces spaced in the thickness direction and comprising a grid formed by a first planar array of spaced parallel longitudinal members and a second planar array of spaced parallel transverse members, said longitudinal members and transverse member intersecting within the panel at a series of regularly spaced crossing points, at each crossing point at least one of said members being notched in the thickness direction of the panel to interengage with the respective member of the other array such that said arrays overlap to a limited extent in said thickness direction, said longitudinal transverse members being spaced from respective ones of said major surfaces by at least about one and a half inches.

22. A prefabricated building panel as claimed in claim 21 wherein said longitudinal members present nailing surfaces on one said major surface, said transverse members presenting nailing surfaces on the other said major surface, said nailing surfaces having a width of at least one inch.

23. A prefabricated building panel as claimed in claim 22 wherein said longitudinal and transverse members comprise nominal two inch by four inch standard dimension lumber studs; and wherein the longitudinal members and the transverse members are all notched to an equal extent at each said crossing point.

24. A prefabricated building panel as claimed in claim 22 comprising a peripheral rectangular frame formed by pairs of opposed parallel longitudinal and transverse sides, the arrays of longitudinal and transverse members within said frame being interconnected by non-metallic fastening means, said longitudinal and transverse members presenting nailing surfaces at respective opposite major surfaces of said panel, said nailing surfaces having a width of at least one inch.

* * * * *